US009869314B2

(12) United States Patent
Nuss et al.

(10) Patent No.: US 9,869,314 B2
(45) Date of Patent: Jan. 16, 2018

(54) SCREW PUMP

(71) Applicant: NETZSCH Pumpen & Systeme GmbH, Selb (DE)

(72) Inventors: Eduardo Nuss, Pomerode/SC (BR); Arthur Zinke, Pomerode/SC (BR); Aluisio Loth, /SCPomerode (BR); Klaus Heizinger, Pomerode/SC (BR); Lorenz Lessmann, Pomerode/SC (BR); Sérgio Krahn, Pomerode/SC (BR); Rui Keunecke, Pomerode/SC (BR); Silvio Beneduzzi, Blumenau (BR); Egon Weege, Pomerode/SC (BR); Nilton André Theilacker, Timbo (BR); Sidney Guedes, Blumenau (BR); Petra Lutke, Pomerode/SC (BR); Robert Kurz, Aschheim (DE); Josef Strassl, Straubing (DE); Johann Kreidl, Waldkraiburg (DE); Hisham Kamal, Waldkraiburg (DE); Horst Engl, Roth (DE); George Balcerczyk, Lisle (CA); Matthias Gradl, Sesslach (DE); Gunther Herr, Haarth (DE); André Nijmeh, Merkendorf (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 175 days.

(21) Appl. No.: 14/840,886

(22) Filed: Aug. 31, 2015

(65) Prior Publication Data

US 2015/0369241 A1 Dec. 24, 2015

Related U.S. Application Data

(63) Continuation of application No. PCT/DE2014/000087, filed on Feb. 25, 2014.

(30) Foreign Application Priority Data

Mar. 1, 2013 (DE) ..... 10 2013 102 030

(51) Int. Cl.
*F04C 29/04* (2006.01)
*F04C 3/08* (2006.01)
(Continued)

(52) U.S. Cl.
CPC ..... *F04C 3/08* (2013.01); *F04C 2/165* (2013.01); *F04C 15/06* (2013.01);
(Continued)

(58) Field of Classification Search
CPC .. F04C 15/06; F04C 2240/20; F04C 2240/60; F04C 2250/10; F04C 2250/201; F04C 2/165; F04C 3/08; F04C 2240/30
(Continued)

(56) References Cited

U.S. PATENT DOCUMENTS 1,751,703 A * 3/1930 Long ..... F04C 2/16 384/428
4,671,749 A * 6/1987 Naraki ..... F04C 18/16 418/149
(Continued)

FOREIGN PATENT DOCUMENTS

DE 1217542 B 5/1966
EP 0523550 A1 1/1993

OTHER PUBLICATIONS

International Search Report Application No. PCT/DE2014/000087 Completed: Jul. 31, 2014; dated Aug. 8, 2014 3 pages.

*Primary Examiner* — Mark Laurenzi
*Assistant Examiner* — Anthony Ayala Delgado
(74) *Attorney, Agent, or Firm* — Whitmyer IP Group LLC

(57) ABSTRACT

A screw spindle pump for the delivery of fluid media with a pump housing having an inlet channel with a first longi-
(Continued)

tudinal axis, an outlet channel with a second longitudinal axis, a first drive spindle with a third longitudinal axis, and a second driven spindle. The spindles each include a profiled section between the inlet channel and the outlet channel, wherein the profiled sections of the spindles are engaged at least partially with one another and form, with the pump housing between the inlet channel and the outlet channel, a delivery section parallel to the longitudinal axis of the drive spindle with delivery chambers for the fluid medium. The second longitudinal axis of the outlet channel is disposed at an obtuse angle to the delivery section in the pump housing. The invention also relates to a method for operating a screw spindle pump.

7 Claims, 4 Drawing Sheets

(51) Int. Cl.
*F04C 15/06* (2006.01)
*F04C 2/16* (2006.01)

(52) U.S. Cl.
CPC ..... *F04C 2240/20* (2013.01); *F04C 2240/30* (2013.01); *F04C 2240/60* (2013.01); *F04C 2250/10* (2013.01); *F04C 2250/201* (2013.01)

(58) Field of Classification Search
USPC ..... 418/203
See application file for complete search history.

(56) References Cited

U.S. PATENT DOCUMENTS 6,050,797 A * 4/2000 Zhong ..... F04C 29/0021 418/203
6,638,043 B1 10/2003 Khalifa
2011/0158841 A1 6/2011 Liu et al.

* cited by examiner

SCREW PUMP

FIELD OF THE INVENTION

The present invention relates to a screw spindle pump and a method for operating a screw spindle pump.

BACKGROUND OF THE INVENTION

The screw spindle pump is a so-called displacement pump, wherein the form of the rotating displacer resembles that of a spindle screw. The screw spindle pump comprises two or more contrarotating rotors and a pump housing which encloses the rotors. The rotors are constituted with a regular threaded profiling and engage with one another in a cog-wheel-like manner. The rotors are also referred to as screw spindles and comprise at least a first shank section and a profiled section with a screw-like or helical profile. The hollow spaces, which are formed by the at least three structural elements—pump housing, first screw spindle and at least second screw spindle, form the delivery spaces for the delivered medium. When the screw spindles are rotated, the delivery spaces move in a machine direction and deliver the medium inside the pump housing from the suction side (=inlet channel) to the pressure side (=outlet channel).

This type of pump is particularly well suited for incompressible as well as viscous media and for generating high pressures. Screw spindle pumps are used for the transport of single-phase as well as multi-phase fluids. The three-spindle screw spindle pump is used predominantly for pumping lubricants that are free of abrasive materials. They are characterised in particular by the fact that it is possible to generate high pressures up to 160 bar with them.

In the case of three-spindle screw spindle pumps, the three spindles are usually disposed in such a way that a drive spindle lying in the middle (also referred to as the male screw) drives two laterally engaging female screw spindles. The drive spindle, for its part, is connected to a drive motor, which can be constituted both as an electric motor and as an internal combustion engine. The torque generated by the drive is transmitted from the drive spindle via the spindle profile to the driven spindles. The spindle profiles engaging with one another produce closed delivery chambers, in which the delivery medium is enclosed and transported in the axial direction from the suction side to the pressure side.

In order to reduce the loads acting on the male screw, the female screws are positioned, proceeding from the rotational axis of the male screw, at an angle of 180° in the pump housing, which balances out the radial force effect on the male screw. The female screws are mounted hydraulically, in that the pump delivery medium is pressed under pressure and motion into the small gap between the screws and the pump housing and thus builds up the carrier film, which in turn prevents tarnishing of the spindles. Housing denotes the part of the pump in which all three spindles are embedded. The delivery chambers are sealed off at the external diameter of the respective pump spindle on the housing.

The problem of the invention is to optimise the flow of the transported medium in the pump, in particular in the region of the outlet channel. Moreover, the formation of eddies which disrupt the transport and lead to flow losses are reduced in this region.

The above problem is solved by a screw spindle pump and a method for operating a screw spindle pump which has the features in claims 1 and 12. Further advantageous embodiments are described in the sub-claims.

SUMMARY OF THE INVENTION

The invention relates to a screw spindle pump for the delivery of fluid media, in particular of incompressible or viscous media. A first drive spindle and at least a second driven spindle are disposed in a pump housing comprising at least one inlet channel and at least one outlet channel. The at least one inlet channel is constituted for example as a first bore with a first longitudinal axis. The at least one outlet channel is constituted for example as a second bore with a second longitudinal axis. The drive spindle has a third longitudinal axis and comprises a shank section, which is mounted rotatably in the pump housing at least section-wise by means of a bearing, and a profiled section which is constituted spindle-like or helical. A drive is assigned to the free external end of the drive spindle. Furthermore, at least a second driven spindle is disposed in the pump housing. It is preferably a three-spindle screw spindle pump with a drive spindle and two driven female screw spindles. The at least two spindles each comprise a profiled section with a spindle-shaped or helical profile between the inlet channel and the outlet channel, wherein the profiled sections of the at least two spindles engage at least partially with one another. The so-called delivery section for the fluid medium is thus constituted in the region between the inlet channel and the outlet channel. In particular, the pump housing and the profiled sections of the spindles engaging with one another constitute the delivery chambers, in which the medium is transported between the inlet channel and the outlet channel in the delivery direction parallel to the longitudinal axes of the spindles.

According to the invention, the second longitudinal axis of the outlet channel is disposed at an obtuse angle, i.e. at an angle of more than 90°, to the delivery section. This means that the delivery section and the second longitudinal axis of the outlet channel form an angle which is greater than 90°. On account of the selected arrangement of the inlet channel and the outlet channel in relation to the delivery section in the pump housing, the fluid medium flows in a first flow direction through the inlet channel into the pump housing, wherein the first longitudinal axis of the inlet channel is disposed largely orthogonal to the delivery section. The fluid medium is deflected in a region downstream of the inlet channel and transported in the delivery direction along the delivery section inside the delivery chambers. The medium is then deflected again and leaves the pump housing in a second flow direction through the outlet channel. The angle that is formed between the delivery section and the outlet channel is obtuse. This means that the angle between the delivery section and the outlet channel is greater than 90°. The opposite angle between an imaginary extension of the delivery section beyond the outlet channel and the outlet channel is therefore acute. The delivery medium is deflected from the imaginary extension at the acute opposite angle into the outlet channel. This means that the delivery medium is deflected from the delivery direction into the outlet channel by an angle which is less than 90°. As a result of the inclined arrangement of the outlet channel in relation to the delivery section and the smaller deflection of the flow direction of the medium thereby brought about in the region of the outlet channel, an advantageous flow of the medium in this region is achieved unlike in the prior art. In particular, the formation of eddies in the outlet channel can thus be reduced markedly.

According to a further embodiment, the drive spindle is constituted at least section-wise as a cone. In particular, the drive spindle is constituted at least section-wise as a concavely rounded cone. The region that is disposed in the region of the outlet channel in the assembled pump is preferably constituted section-wise as a conically shaped section, in particular as a concavely rounded conically shaped section. The drive spindle comprises a profiled section and a shank section, which is mounted section-wise at a bearing of the pump housing. The conically shaped section is a partial section of the shank section and is directly adjacent to the profiled section. The cross-section of the conically shaped section, in particular the cross-section of the concavely rounded conically shaped section, is preferably reduced or tapered in the direction of the profiled section.

The delivered medium is advantageously conveyed via the preferably concavely rounded conically shaped section of the drive spindle into the second flow direction produced by the arrangement of the outlet channel. The second flow direction forms with the delivery section an angle not equal to 90°, in particular an obtuse angle, i.e. an angle that is greater than 90°.

Unlike the drive spindle, the at least one driven female screw spindle is disposed completely inside the pump housing and mounted rotatably.

It is preferably a three-spindle screw spindle pump with a first drive spindle and two female screw spindles, wherein the longitudinal axes of the three spindles are disposed in parallel and in a plane. In particular, the longitudinal axis of the drive spindle is disposed centrally between the longitudinal axes of the female screw spindles.

The invention further relates to a method for operating a screw spindle pump for the delivery of a fluid medium, wherein the fluid medium is introduced through at least one inlet channel in a first flow direction into the pump housing. The first flow direction is largely orthogonal to the delivery direction of the medium in the pump housing. The medium is deflected through approx. 90° in a region downstream of the at least one inlet channel and transported in the delivery direction along the longitudinal axes of the spindles through the pump housing. At the end of the delivery section, the medium is deflected from its delivery direction into an outflow direction into the outlet channel. The deflection angle resulting from the arrangement of the outlet channel is less than 90°, i.e. the medium is deflected by less than 90° from the delivery direction. The medium then leaves the pump housing via the at least one outlet channel in the second flow direction. The medium is thus deflected to a lesser extent in the region upstream of the at least one outlet channel than in the case of the conventionally known pumps. The eddy formation in the region of the at least one outlet channel is thus reduced or completely prevented. The advantageous deflection of the fluid medium preferably takes place inside a previously described screw spindle pump.

The solution according to the invention is based in particular on a change to the shape and position of the outlet channel in the pump housing and a change to the shape of the spindle shank of the drive spindle in the region of the outlet channel. The eddy formation and the associated turbulent flow are thus advantageously minimized, as a result of which an improvement in the hydraulic efficiency of the screw spindle pump is achieved. The change to the pump housing provides in particular for an inclined position of the outlet channel both in the axial direction and in the radial direction with respect to the drive spindle.

The drive spindle also comprises a cone tapering at least section-wise concavely in the direction of the profiled section, said cone deflecting the flow of the delivered medium laterally into the inclined outlet channel. As a result of the inclined outlet channel on the pump housing and the flow-guiding, preferably concavely rounded cone on the drive rotor, the flow resistance is advantageously reduced especially in the case of highly viscous fluids, which in turn has a favourable effect on the efficiency of the pump. The favourable effect achieved by the optimised flow control at the outlet channel of the screw spindle pump can be demonstrated by means of a computer-assisted dynamic fluid simulation.

The design modifications to the pump housing and to the drive spindle can be achieved in a straightforward and cost-effective manner, so that with simple means and at low cost the overall efficiency of a screw spindle pump according to the invention can be increased markedly compared to the prior art.

BRIEF DESCRIPTION OF THE DRAWINGS

Examples of embodiment of the invention and its advantages are explained in greater detail below with the aid of the appended figures. The size ratios of the individual elements with respect to one another in the figures do not always correspond to the actual size ratios, since some forms are represented simplified and other forms magnified compared to other elements for the sake of better clarity.

DETAILED DESCRIPTION OF THE INVENTION

Identical reference numbers are used for identical or identically acting elements of the invention. Furthermore, for the sake of clarity, only reference numbers that are required for the description of the given figure are represented in the individual figures. The represented embodiments only represent examples as to how the device according to the invention or the method according to the invention can be constituted and do not represent a conclusive limitation.

Figure 1A:
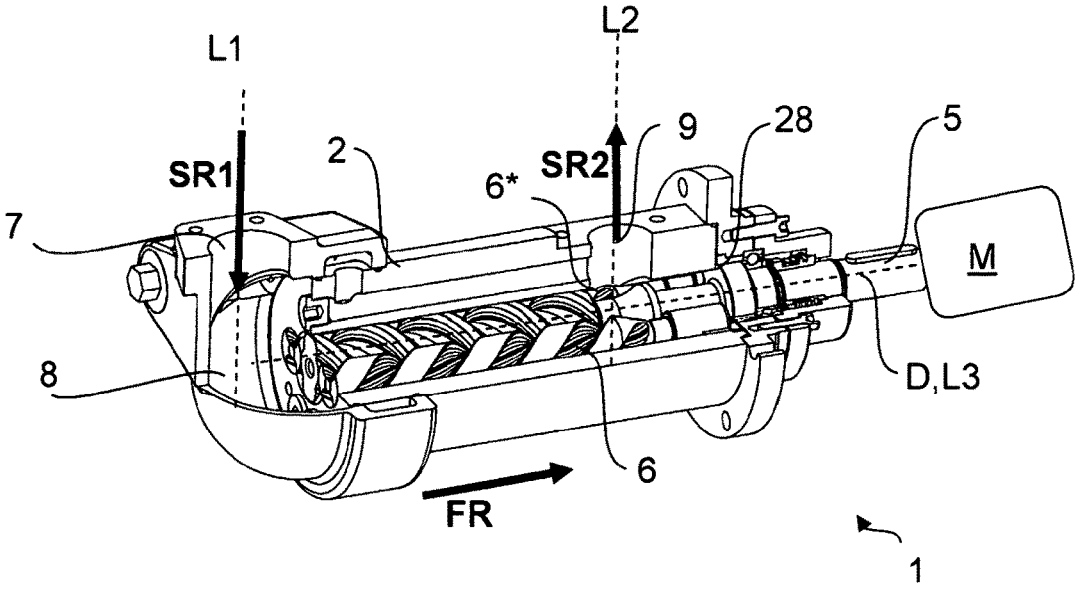
FIGS. 1A-1B show a screw spindle pump according to the invention.
Figure 1B:
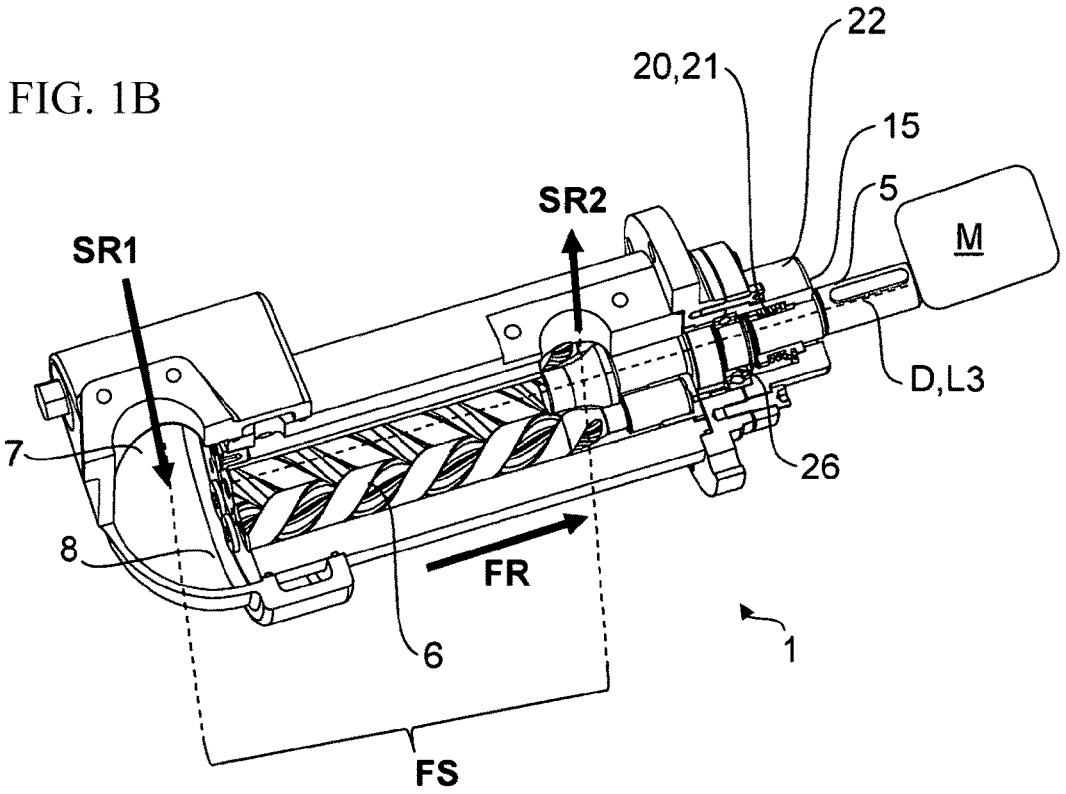

FIGS. 1A and 1B show a screw spindle pump 1 according to the invention with pump housing 2. A drive spindle 5, a first female screw spindle 6 and a second female screw spindle 6* (scarcely visible, see FIG. 5) are disposed in said pump housing. In particular, second female screw spindle 6* is disposed, proceeding from rotational axis D of drive spindle 5, at an angle of 180° to first female screw spindle 6 in pump housing 2, i.e. the longitudinal axes or rotational axes of the three spindles 5, 6, 6* lie in a plane. The delivered medium flows in flow direction SR1 through inlet channel 7 along a first longitudinal axis L1 into pump housing 2. In inlet region 8, the delivered medium is deflected and is now transported in delivery direction FR parallel to rotational axis D or longitudinal axis L3 of drive spindle 5 through pump housing 2. In the described example of embodiment, rotational axis D corresponds to longitudinal axis L3 of drive spindle 5. The medium then leaves pump housing 2 via outlet channel 9 along a second longitudinal axis L2. The delivered medium is thus transported in the axial direction from the suction side to the pressure side.

Drive spindle 5 is hydraulically mounted in pump housing 2 over the entire length of the turns, i.e. in its entire profiled section P (see FIG. 2). Pump housing 2 comprises an accommodation housing 22 for a shaft seal 20 and a ball bearing 26 of drive spindle 5, from which a shaft section A exits section-wise through an opening 15 from pump housing 2. Sealing elements 21 are disposed on drive spindle 5 as shaft seal 20 in accommodation housing 22 in order to seal pump housing 2 in the region of shaft exit opening 15. In a shaft section A adjacent to profiled section P, drive spindle 5 is again mounted mechanically by means of ball bearing 26 in a zone of low pressure. Shaft seal 20 takes place in particular by means of sealing elements 21, which enable a rotation of drive spindle 5 relative to pump housing 2, for example slide ring seals, shaft sealing rings or stuffing box packings. A further sealing system is assigned to shaft section AD of the shaft shank of drive spindle 5 with an enlarged diameter (see FIG. 2) as a labyrinth seal 28. The latter is capable of reducing the pressure from the high-pressure side to the low-pressure side. The gap flow thus arising prevents jamming of drive spindle 5 in pump housing 2 and at the same time lubricates ball bearing 26. Furthermore, widened section AD of the shaft shank of drive spindle 5 designed as a hydraulically operating compensating piston 28 reduces the axial bearing forces, in that the forces acting on the screw profile are roughly balanced out hydraulically with those of the compensatory piston.

The continuous leakage flow exiting towards the low-pressure side is responsible for the heat exchange and the lubrication of sealing elements 21 of shaft seal 20, for example of the slide ring seals. The leakage flow is carried away via a channel to the suction side and thus prevents a gradual pressure increase in the sealing space.

The hollow spaces that are formed by pump housing 2, drive spindle 5 and female screw spindles 6, 6* form the delivery spaces for the delivered medium. When screw spindles 5, 6, 6* rotate, the delivery spaces move in delivery direction FR and thus deliver the medium from the suction side (=inlet channel) to the pressure side (=outlet channel).

The delivered medium flows through inlet channel 7 largely orthogonal to the longitudinal axis of spindles 5, 6, 6* into pump housing 2 and is deflected in inlet region 8. The delivered medium is then moved by the motion of screw spindles 5, 6, 6* in the delivery spaces formed inside the pump housing in the direction of drive M. Delivery direction FR is largely parallel to longitudinal axis L3 of drive spindle 5. The delivered medium is then again deflected and leaves pump housing 2, whereby it flows out through an outlet channel 9. The section through which the medium has passed inside the pump housing is also referred to as delivery section FS.

Longitudinal axis L2 of outlet channel 9 in pump housing 2 is preferably disposed at an angle not equal to 90° with respect to longitudinal axis L3 of drive spindle 5. In particular, outlet channel 9 is constituted inclined in such a way that an obtuse angle is formed between profiled section P of drive spindle 5 and longitudinal axis L2 of outlet channel 9. The medium leaves pump housing 2 through outlet channel 9 in a second flow direction SR2. This second flow direction SR2 or second longitudinal axis L2 of outlet channel 9 forms an obtuse angle with delivery section FS. Since longitudinal axis L1 of inlet channel 7 is preferably disposed orthogonal to longitudinal axis L3 of drive spindle 5, it emerges that first longitudinal axis L1 of inlet channel 7 and second longitudinal axis L2 of outlet channel 9 are disposed in a common plane at an angle to one another. Alternatively, provision can also be made such that first longitudinal axis L1 of inlet channel 7 and third longitudinal axis L3 of drive spindle 5 define a first plane and that second longitudinal axis L2 of outlet channel 9 is not disposed in this plane. In particular, in this alternative embodiment, second longitudinal axis L2 of outlet channel 9 is disposed in another plane and at an angle with respect to first longitudinal axis L1 of the inlet channel. In conventional pumps, on the other hand, the flow direction of the delivered medium in the region of inlet channel 7 is usually largely parallel to the flow direction of the delivered medium in the region of outlet channel 9, and the flow direction of the delivered medium in the region of the outlet channel is largely orthogonal to delivery direction FR along the longitudinal axis of the drive spindle inside the pump housing.

Figure 2A:
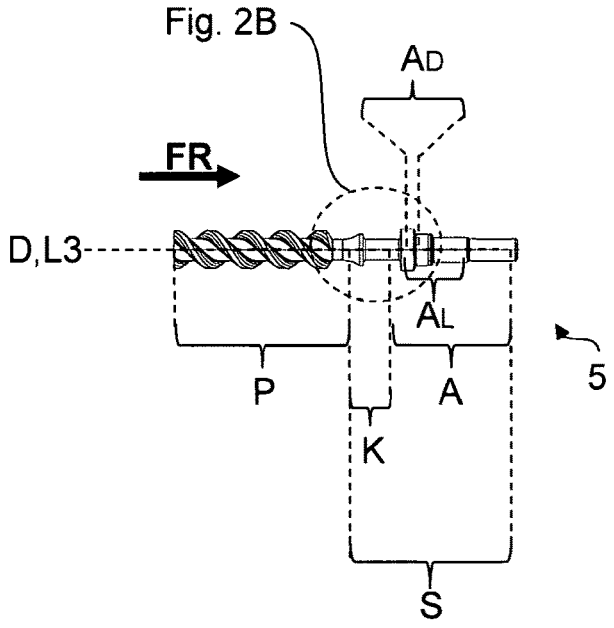
FIGS. 2A-2B show a drive spindle with a modification according to the invention.
Figure 2B:
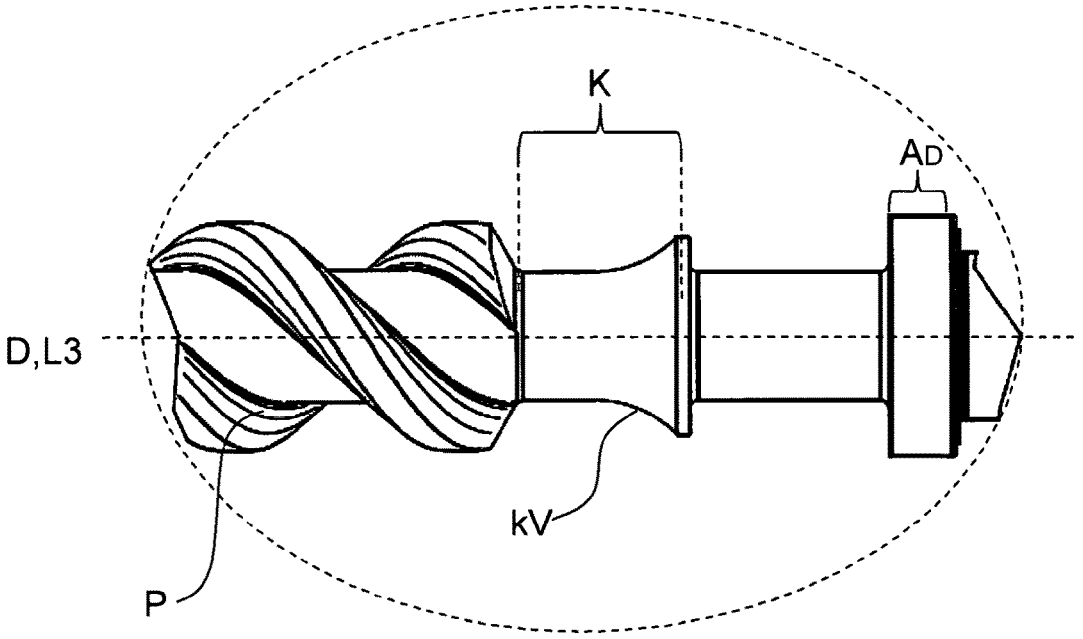

FIGS. 2A and 2B show a drive spindle 5 with a modification according to the invention. The latter comprises a profiled section P with a formed spindle profile or with a helical profile, which together with the profiled sections of female screw spindles 6, 6* (see FIGS. 1A and 1B) form the delivery chambers for the medium to be delivered. Furthermore, drive spindle 5 comprises a shank section S. The latter comprises a shaft section A with bearing section AL. In ready-assembled screw spindle pump 1, bearing section AL is mounted rotatably in ball bearing 26 of accommodation housing 22 constituted as shaft exit opening 15 and part of pump housing 2 (see FIGS. 1A and 1B). Disposed between axial section A and profiled section P is a conically shaped section K. The conically shaped section K is located inside pump housing 2 in the region of outlet channel 9 in the assembled screw spindle pump 1. The diameter of conically shaped section K tapers against delivery direction FR of the medium inside pump housing 2. In particular, conically shaped section K is constituted as a concavely rounded cone. Additionally, conically shaped section K on drive spindle 5 generates a swirl of the delivered medium and leads to better introduction of the delivered medium at the stator or into outlet channel 9 (see FIGS. 1A and 1B).

On account of the structurally differently selected shape and position of outlet channel 9, in particular on account of the inclined position of outlet channel 9, there is a less marked deflection of the delivered medium between delivery direction FR and second flow direction SR2 in the region of outlet channel 9. This, in combination with concavely rounded conically shaped section K, produces an advantageous flow of the delivered medium in the region of outlet channel 9. In particular, the eddy formation is reduced and the flow is therefore less turbulent. An improvement in the hydraulic efficiency of screw spindle pump 1 is thus achieved.

Concavely rounded conically shaped section K also performs the additional function of preventing an axial displacement of female screw spindles 6, 6* (see FIGS. 1A and 1B) including their bearing bushes.

FIG. 2 B shows a detail region of drive spindle 5. In particular, conically shaped section K tapers at least section-wise concavely (see reference symbol kV) in the direction of profiled section P. This brings about the advantageous deflection of the flow of the delivered medium laterally into inclined outlet channel 9 (see FIGS. 1 and 3).

Figure 3A:
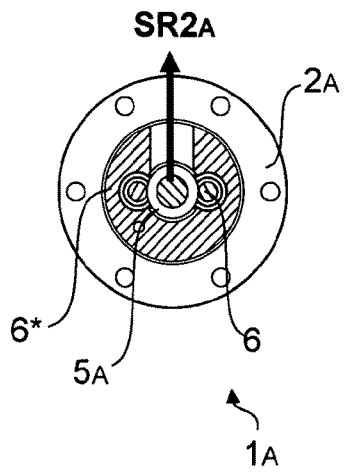
FIGS. 3A-3B each show a cross-section through the outlet region of a screw spindle pump.
Figure 3B:
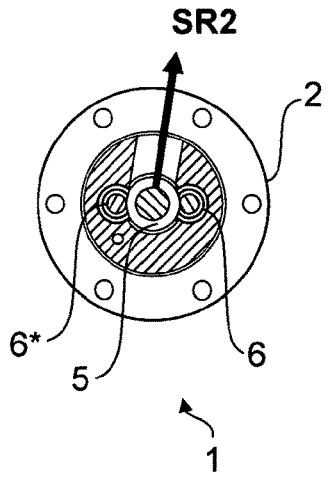
Figure 4A:
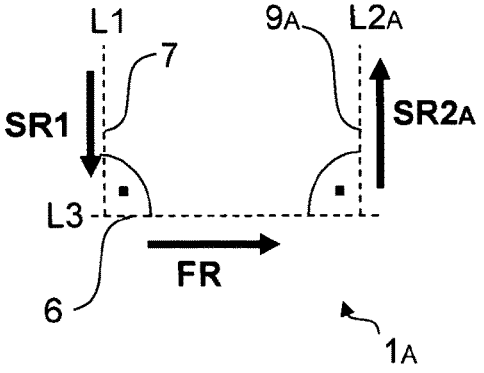
FIGS. 4A-4B show diagrammatically the arrangements of various longitudinal axes in the pump housing.
Figure 4B:
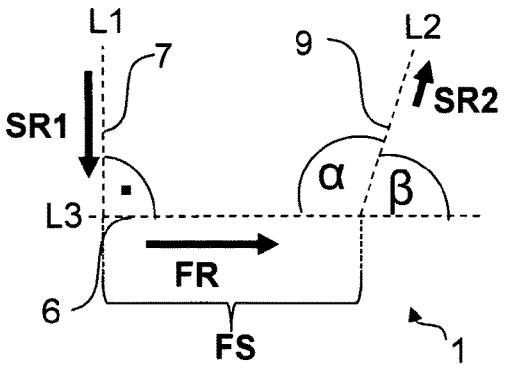

FIGS. 3A and 3B each show a cross-section through the outlet region of a screw spindle pump 1, 1A. FIGS. 4A and 4B show diagrammatically the arrangements of first longitudinal axis L1 of inlet channel 7, second longitudinal axis L2, L2A of outlet channel 9, 9 A and third longitudinal axis L3 of drive spindle 5 in the pump housing. Longitudinal axis L1 of inlet channel 7 is disposed orthogonal to third longitudinal axis L3 of drive spindle 5 both in the case of a screw spindle pump 1A according to the prior art and in the case of a screw spindle pump 1 according to the invention. In particular, FIGS. 3A and 4A show the prior art of a screw spindle pump 1A, wherein outlet channel 9A is disposed orthogonal to longitudinal axis L3 of drive spindle 5 (see FIG. 1) and therefore brings about a deflection of the delivered medium through approx. 90° from delivery direction FR into second flow direction SR2A (see FIGS. 1A and 1B). In the prior art according to the represented embodiment of a screw spindle pump 1A, first inflow direction SR1A and second outflow direction SR1A are thus orientated anti-parallel with respect to one another. In a conventional screw spindle pump 1A, longitudinal axis L1 of inlet channel 7 and third longitudinal axis L3 of drive spindle 5 form a plane. Second longitudinal axis L2A of outlet channel 9A is also located in this plane, i.e. first longitudinal axis L1 of inlet channel 7 and second longitudinal axis L2A of outlet channel 9A are disposed parallel with one another. According to a further embodiment (not represented), first longitudinal axis L1 of inlet channel 7 and second longitudinal axis L2A of outlet channel 9A in the prior art can each be disposed orthogonal to third longitudinal axis L3 of drive spindle 5, but not parallel with one another. This means that the two longitudinal axes L1, L2 are skewed with respect to one another and in particular do not intersect. In this case, too, the delivered medium is deflected from delivery direction FR through approx. 90° into second flow direction SR2A (see FIGS. 1A and 1B). The computer-assisted dynamic fluid simulation shows a marked eddy formation of the medium flowing out through outlet channel 9A in flow direction SR2A.

In the case of inventive screw spindle pump 1 according to FIGS. 3B and 4B, on the other hand, outlet channel 9 is disposed at an obtuse angle $\alpha$ to delivery section FS inside pump housing 2 parallel to longitudinal axis L3 of drive spindle 5. The delivered medium in the region of outlet channel 9 is thus deflected only by an angle $\beta$ into second flow direction SR2, wherein $\beta$ is less than 90°. In particular, the delivered medium is deflected through an angle $\beta=180°-\alpha$. Longitudinal axis L1 of inlet channel 7 and longitudinal axis L3 of drive spindle 5 are thus always disposed at an angle to one another that is not equal to 90°, wherein the point of intersection of longitudinal axes L1 and L3 usually lies outside the pump housing. The computer-assisted dynamic fluid simulation shows a markedly reduced eddy formation of the medium flowing out through outlet channel 9 in flow direction SR2.

The changes to the structure of the pump housing with a differently arranged outlet channel 9 and additional cone K, in particular concave tapering kV of cone K of the drive spindle 5, can be achieved with simple technical means without significant cost outlay. On account of the improved flow behaviour of the delivered medium, the overall efficiency of screw spindle pump 1 can be markedly increased with these low-cost changes.

Figure 5:
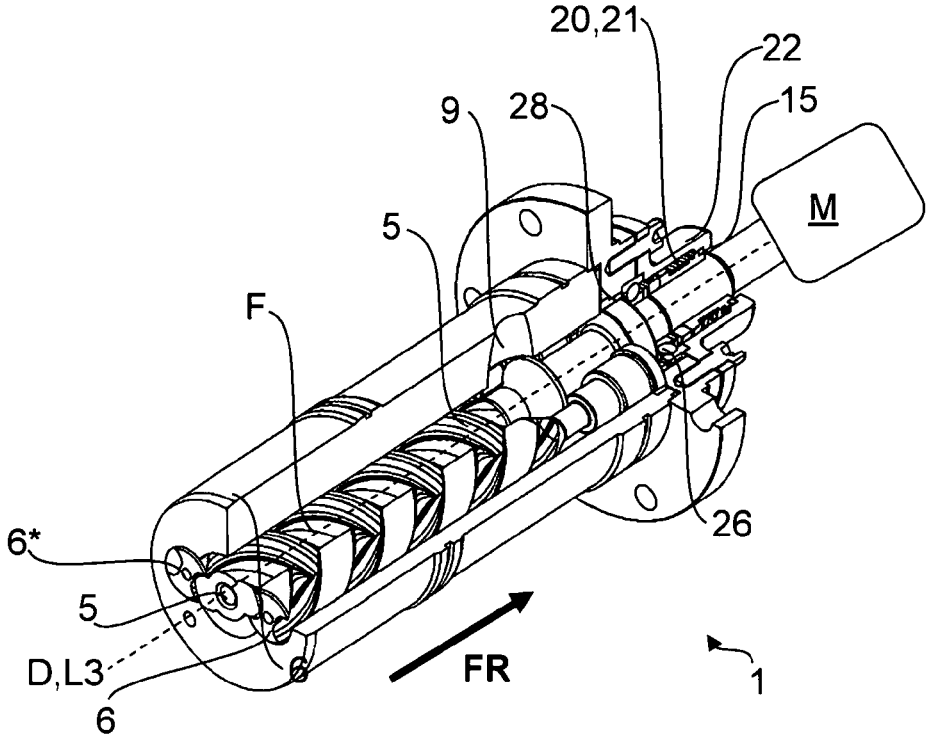
FIG. 5 shows a further representation of a partial region of a screw spindle pump.

FIG. 5 shows a further representation of a partial region of a screw spindle pump 1. In particular, FIG. 5 shows the partial region of pump housing 2 comprising spindles 5, 6, 6*, with the outlet region comprising outlet channel 9. The partial region of pump housing 2 comprising inlet region 8 and inlet channel 7 has not been represented in order to provide a clearer representation of the arrangement of drive spindle 5 and driven female screw spindles 6, 6*. For the description of the reference symbols, reference is made in particular to FIG. 1. Furthermore, a delivery chamber for the transport of the fluid medium is denoted by reference symbol F in FIG. 5, said delivery chamber being constituted by the mutually engaging profiled regions of spindles 5, 6, 6*.

The invention has been described by reference to a preferred embodiment. The person skilled in the art can however imagine that modifications or changes to the invention can be made without thereby departing from the scope of protection of the following claims.

The invention claimed is:

1. A screw spindle pump for the delivery of fluid media with a pump housing, comprising:

at least one inlet channel with a first longitudinal axis;

at least one outlet channel with a second longitudinal axis;

a drive spindle with a third longitudinal axis; and at least one driven spindle;

wherein the drive spindle and at least one driven spindle are disposed at least section-wise in the pump housing, the drive spindle and at least one driven spindle each comprise a profiled section between the at least one inlet channel and the at least one outlet channel, wherein the profiled sections of the drive spindle and at least one driven spindle are engaged at least partially with one another and form, with the pump housing between the at least one inlet channel and the at least one outlet channel, a delivery section parallel to the third longitudinal axis of the drive spindle with delivery chambers for the fluid medium;

wherein the second longitudinal axis of the at least one outlet channel is disposed at an obtuse angle to the delivery section in the pump housing; and wherein the drive spindle comprises a profiled section and a shank section, the drive spindle in a section adjacent to the outlet channel is constituted as an at least section-wise concavely rounded conically shaped section, and the at least section-wise concavely rounded conically shaped section is a partial section of the shank section and is adjacent to the profiled section.

2. A screw spindle pump for the delivery of fluid media with a pump housing, comprising:

at least one inlet channel with a first longitudinal axis;

at least one outlet channel with a second longitudinal axis;

a drive spindle with a third longitudinal axis; and at least one driven spindle;

wherein the drive spindle and at least one driven spindle are disposed at least section-wise in the pump housing, the drive spindle and at least one driven spindle each comprise a profiled section between the at least one inlet channel and the at least one outlet channel, wherein the profiled sections of the drive spindle and at least one driven spindle are engaged at least partially with one another and form, with the pump housing between the at least one inlet channel and the at least one outlet channel, a delivery section parallel to the third longitudinal axis of the drive spindle with delivery chambers for the fluid medium;

wherein the second longitudinal axis of the at least one outlet channel is disposed at an obtuse angle to the delivery section in the pump housing;

wherein the drive spindle is constituted at least section-wise as a concavely rounded conically shaped section; and wherein the concavely rounded conically shaped section tapers in the direction of the profiled section.

3. The screw spindle pump of claim 1, wherein the fluid medium can be conveyed via the concavely rounded conically shaped section into a second flow direction (SR2), wherein the second flow direction forms with the delivery section an angle that is not equal to 90°.

4. The screw spindle pump of claim 3, wherein the second flow direction forms with the delivery section an angle that is greater than 90°.

5. The screw spindle pump of claim 1, wherein an eddy formation of the delivered medium is reduced in a region of the at least one outlet channel of the screw spindle pump.

6. The screw spindle pump of claim 1, wherein at least a second driven spindle is disposed completely inside the pump housing.

7. A screw spindle pump for the delivery of fluid media with a pump housing, comprising:

at least one inlet channel with a first longitudinal axis;

at least one outlet channel with a second longitudinal axis;

a drive spindle with a third longitudinal axis; and at least one driven spindle;

wherein the drive spindle and at least one driven spindle are disposed at least section-wise in the pump housing, the drive spindle and at least one driven spindle each comprise a profiled section between the at least one inlet channel and the at least one outlet channel, wherein the profiled sections of the drive spindle and at least one driven spindle are engaged at least partially with one another and form, with the pump housing between the at least one inlet channel and the at least one outlet channel, a delivery section parallel to the third longitudinal axis of the drive spindle with delivery chambers for the fluid medium;

wherein the second longitudinal axis of the at least one outlet channel is disposed at an obtuse angle to the delivery section in the pump housing; and wherein the screw spindle pump has three spindles, with a drive spindle and two female screw spindles, wherein the longitudinal axes of the three spindles are disposed in parallel and in a plane, wherein the longitudinal axis of the drive spindle is disposed centrally between the longitudinal axes of the female screw spindles.

* * * * *